US006817049B1

(12) United States Patent
Hall

(10) Patent No.: US 6,817,049 B1
(45) Date of Patent: Nov. 16, 2004

(54) THERAPEUTIC PILLOW

(76) Inventor: Raymond F. Hall, 10780 Santa Monica Blvd., Suite 440, Los Angeles, CA (US) 90025

( * ) Notice: Subject to any disclaimer, the term of this patent is extended or adjusted under 35 U.S.C. 154(b) by 0 days.

(21) Appl. No.: 10/674,927

(22) Filed: Sep. 30, 2003

(51) Int. Cl.[7] ..... A47G 9/00
(52) U.S. Cl. ..... 5/636; 5/632
(58) Field of Search ..... 5/636, 632, 637, 5/639, 640, 645, 655.9, 657, 953; D6/601

(56) References Cited

U.S. PATENT DOCUMENTS

| | | | | | |
|---|---|---|---|---|---|
| 1,385,355 | A | | 7/1921 | Banks | 5/636 |
| 2,700,779 | A | * | 2/1955 | Tolkowsky | 5/632 |
| 2,940,088 | A | * | 6/1960 | Boos | 5/636 |
| 3,757,365 | A | * | 9/1973 | Kretchmer | 5/636 |
| 4,118,813 | A | * | 10/1978 | Armstrong | 5/638 |
| 4,218,792 | A | * | 8/1980 | Kogan | 5/636 |
| 4,349,925 | A | * | 9/1982 | Macomber | 5/632 |
| 4,432,107 | A | * | 2/1984 | Clark et al. | 5/636 |
| 4,494,261 | A | * | 1/1985 | Morrow | 5/636 |
| 4,850,067 | A | * | 7/1989 | Latorre | 5/636 |
| 4,850,068 | A | | 7/1989 | Walpin et al. | 5/434 |
| 4,924,540 | A | * | 5/1990 | Main | 5/636 |
| D308,455 | S | | 6/1990 | Jenney | D6/601 |
| 5,016,303 | A | * | 5/1991 | Tanaka et al. | 5/636 |
| 5,018,231 | A | * | 5/1991 | Wang | 5/636 |
| 5,457,832 | A | | 10/1995 | Tatum | 5/636 |
| 5,471,691 | A | | 12/1995 | Ryndak | 5/645 |
| 5,682,632 | A | | 11/1997 | Cotroneo | 5/636 |
| 5,708,998 | A | * | 1/1998 | Torbik | 5/636 |
| 5,727,267 | A | | 3/1998 | Keilhauer | 5/636 |
| 5,778,469 | A | | 7/1998 | Festa | 5/636 |
| 5,797,154 | A | | 8/1998 | Contreras | 5/636 |
| 5,864,904 | A | | 2/1999 | Rudick | 5/640 |
| D420,845 | S | | 2/2000 | Rumage | D6/595 |
| 6,073,288 | A | | 6/2000 | Berenstein | 5/636 |
| 6,122,784 | A | | 9/2000 | Hurwitz | 5/636 |
| 6,230,348 | B1 | | 5/2001 | Patrikakis | 5/636 |
| 6,401,279 | B1 | | 6/2002 | Vaughn | 5/644 |
| 6,574,809 | B1 | * | 6/2003 | Rathbun | 5/636 |
| 6,671,906 | B1 | * | 1/2004 | Milligan | 5/636 |
| 2002/0050007 | A1 | | 5/2002 | Kim | 5/636 |
| 2003/0188385 | A1 | * | 10/2003 | Rathbun | 5/636 |
| 2004/0006822 | A1 | * | 1/2004 | Milligan | 5/636 |
| 2004/0068799 | A1 | * | 4/2004 | Wilson | 5/632 |

OTHER PUBLICATIONS

Therapeutica Products, Therapeutica Sleeping Pillows, Focus, Sep. 2000.

* cited by examiner

*Primary Examiner*—Robert G. Santos
(74) *Attorney, Agent, or Firm*—Irell & Manella LLP

(57) ABSTRACT

A triune, substantially bilaterally symmetrical pillow for a reclining human being is configured to provide therapeutic and support and comfort for the head and neck while lying on one's back and side, and allow use in two, opposite orientations to increase durability and functional capacity. A center section is provided with a thin portion, abutted on either side along one axis by two substantially similar convex portions, and abutted on either side along a second axis normal to the first by two substantially identical flat end sections. The end sections have cutaways near the bottoms of their sides, to either side of their connections to the center section, that are designed to accommodate the shoulder of a human user. It is emphasized that this abstract is provided to comply with the rules requiring an abstract which will allow a searcher or other reader to quickly ascertain the subject matter of the technical disclosure. It is submitted with the understanding that it will not be used to interpret or limit the scope or meaning of the claims.

21 Claims, 12 Drawing Sheets

FIG. 1
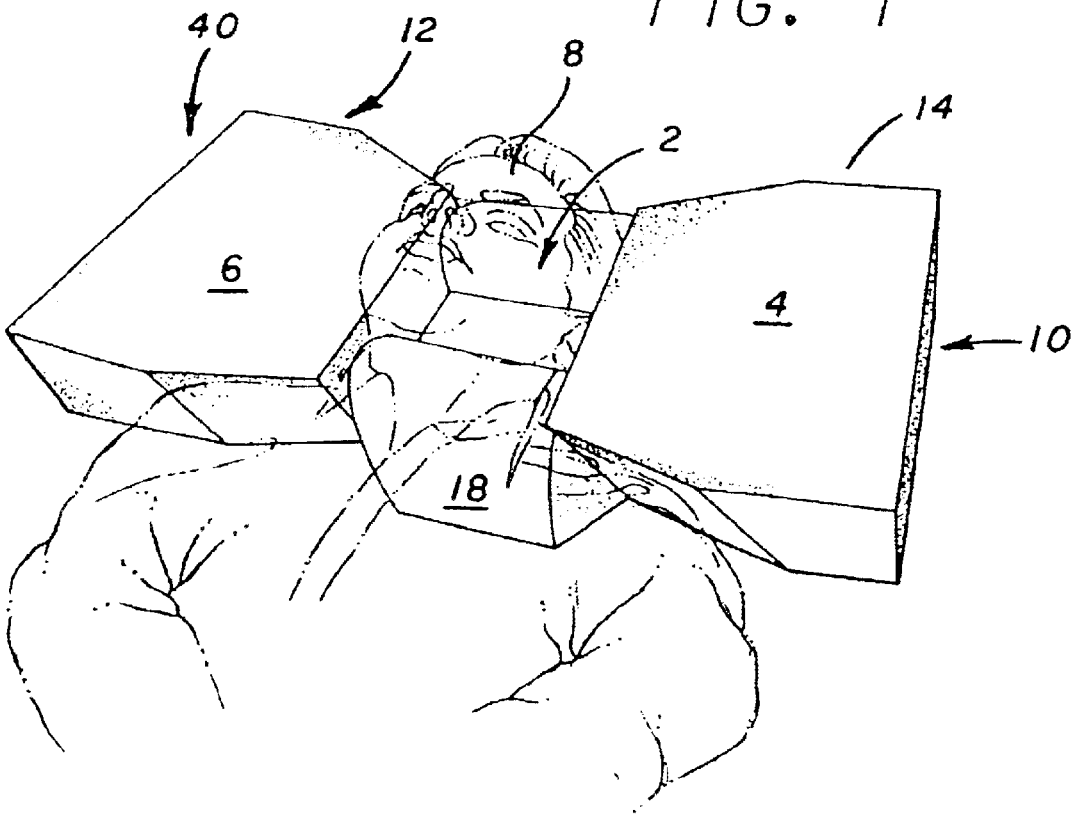
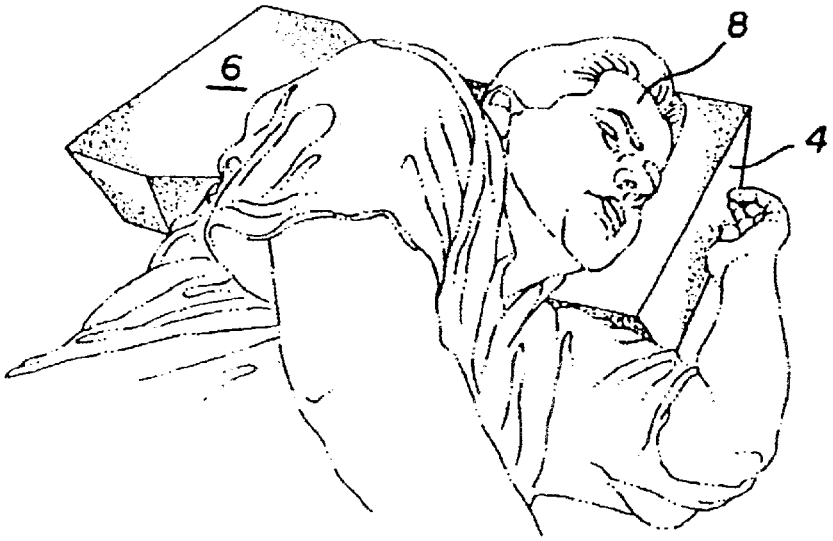
FIG. 2

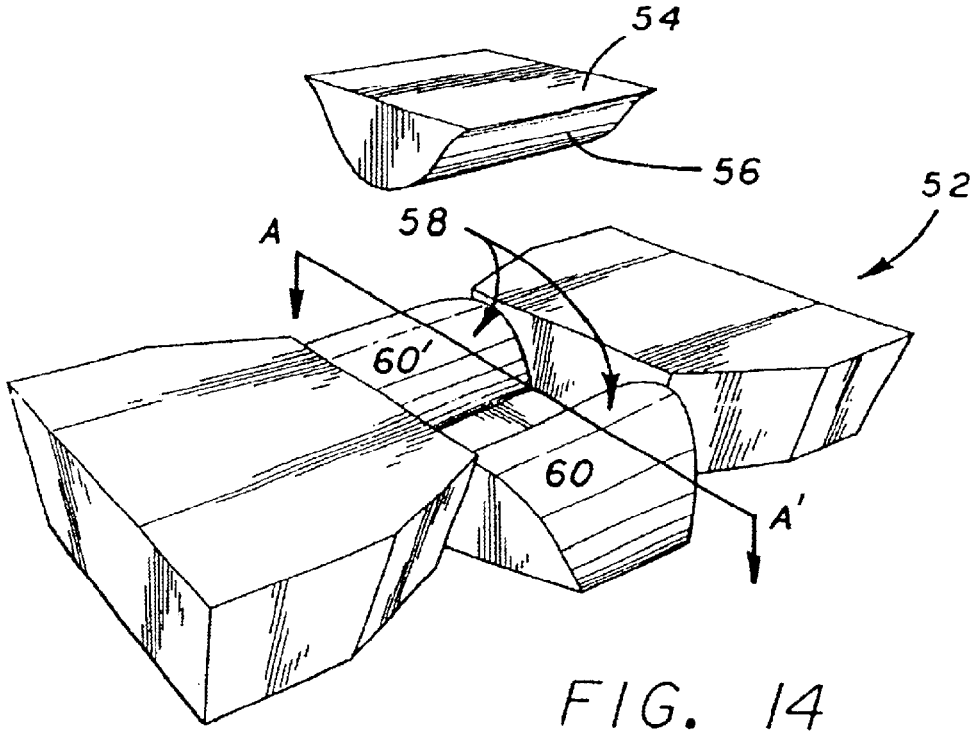
FIG. 14
FIG. 15
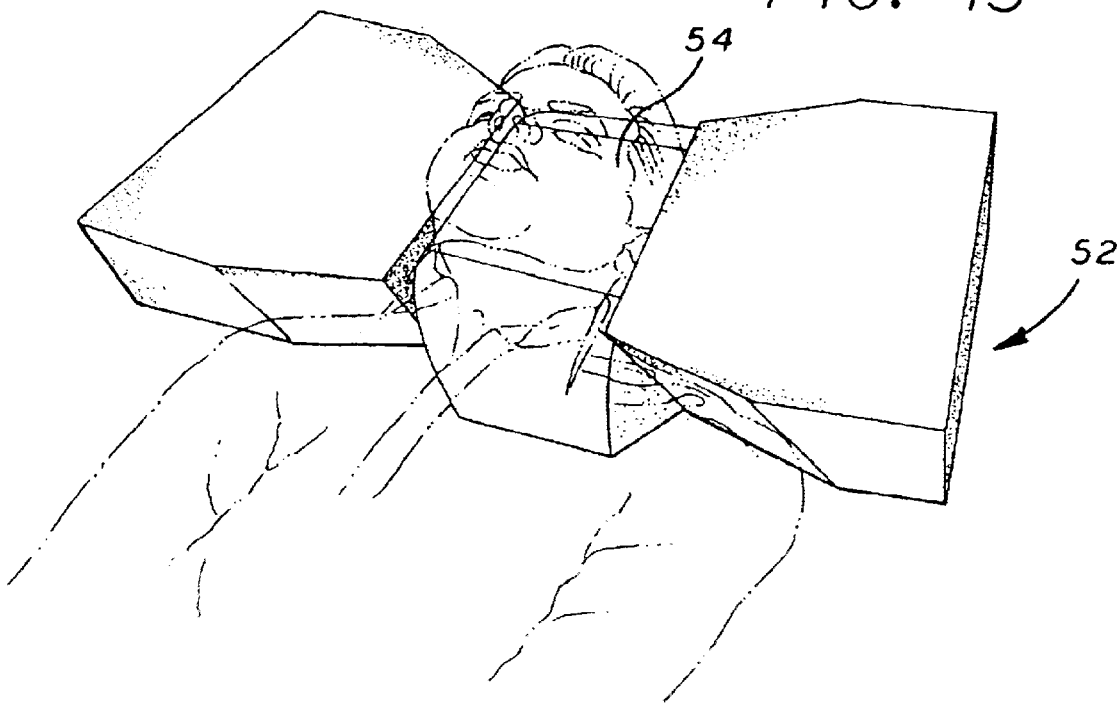

THERAPEUTIC PILLOW

BACKGROUND OF THE INVENTION

1. Field of the Invention

The present invention relates to pillows, in particular pillows to help maintain a reclining human in a healthful therapeutic position.

2. Description of the Prior Art

A common human health problem consists of pain and tension in the head, neck and shoulders. This problem may arise in an otherwise healthy person due to improper support of the head, neck and shoulders during sleeping. Additionally, many injuries and conditions, such as whiplash, sprains, strains, arthritis and disc compression syndromes may increase the need for optimal head and neck support during sleeping to promote healing or reduce exacerbation of the injury or condition during convalescence. The pain and tension may cause further problems associated with difficulties resting, such as increased perspiration during rest, insomnia, restlessness, light sleep, and snoring.

The optimal position of the human cervical spine (neck) is known as the neutral position. This position corresponds substantially to the most anatomically natural position of the cervical spine of a person who is standing upright with correct posture. In the neutral position, the lordotic curve of the cervical spine is maintained such that the lowest degree of stress is placed on the cervical vertebrae and surrounding connective and other tissues, and the minimum amount of neck and back pain are maintained.

When a human's head and neck are in a suboptimal position, the circulation of blood and nutrients through the neck is restricted by constrictions due to stressed connective tissue and vessels. Additionally, suboptimal neck position can lay stress on the nerves in the neck and head causing neurological instability of the vasomotor and muscular mechanical reflexes, among other neurological problems. Suboptimal neck position may also constrict breathing, which can cause or exacerbate snoring, sleep apnea, and other breathing related disorders that affect resting persons.

Humans recline in many positions during rest, including supine (on one's back), lateral (on one's left or right side), and the prone (on one's stomach) position. Known therapeutic pillows are not designed to support the user in all sleeping positions. Some known pillows are designed to support therapeutically the user's head and neck in the supine, but not the lateral position. Other known pillows are intended to support therapeutically the user's head and neck in either the supine or a lateral position depending on the initial position selected by the user, but not to support the user as he or she changes position naturally from supine to lateral, or vice versa, during the course of rest.

What is needed is a therapeutic device that provides proper support of a human cervical spine and head in both the supine and lateral position and permits transition between positions during sleep.

SUMMARY OF THE INVENTION

A therapeutic pillow includes a central pad, having a generally rectangular head support pad and a pair of cervical support pads each positioned along one of a first set of opposite edges of the head support pad, and a pair of side support pads each positioned along one of a second set of opposite edges of the head support pad, a portion of each side support pad adjacent one or more of said first pair of opposite edges of the head support pad being relieved to form a angular shoulder relief area for a user reclining in a lateral position with the user's face supported by one of said Bide support pads and the user's cervical spine supported by one of the cervical supports.

A portion of the central pad and/or cervical pads adjacent each of said angular shoulder relief areas formed in the side support pads may also be relieved to increase the shoulder relief area. The relieved portion of each side support pad may also relieved in a vertical plane by undercutting so that the upper surface of each side support pad extends beyond the lower surface to provide additional support for the user's face and additional relief area for the user's shoulder. The relief in the vertical plane may also include a generally concave surface forming an overhang in the upper surface of each side support pad for providing additional support for the user's face.

The vertical heights of the side support and cervical support pads permit a user to roll easily between supine and lateral reclining positions and the central and side support pads may be configured to form a pillow having substantially bilaterally symmetry so that the pillow may be used after 180 degrees of horizontal rotation.

These and other features and advantages of this invention will become further apparent from the detailed description and accompanying figures that follow. In the figures and description, numerals indicate the various features of the invention, like numerals referring to like features throughout both the drawings and the description.

BRIEF DESCRIPTION OF THE DRAWINGS

FIG. 1 is an oblique perspective of a pillow in accordance with the present disclosure depicting its use by a user in a supine reclining position.

FIG. 2 is a perspective of a pillow in accordance with the present disclosure depicting its use by a user in a lateral reclining position.

FIG. 14 is an oblique perspective of another embodiment of a pillow in accordance with the present disclosure.

FIG. 15 is a perspective of the pillow of FIG. 14 depicting its use by a user reclining supine.

DETAILED DESCRIPTION OF THE PREFERRED EMBODIMENT(S)

Figure 3:
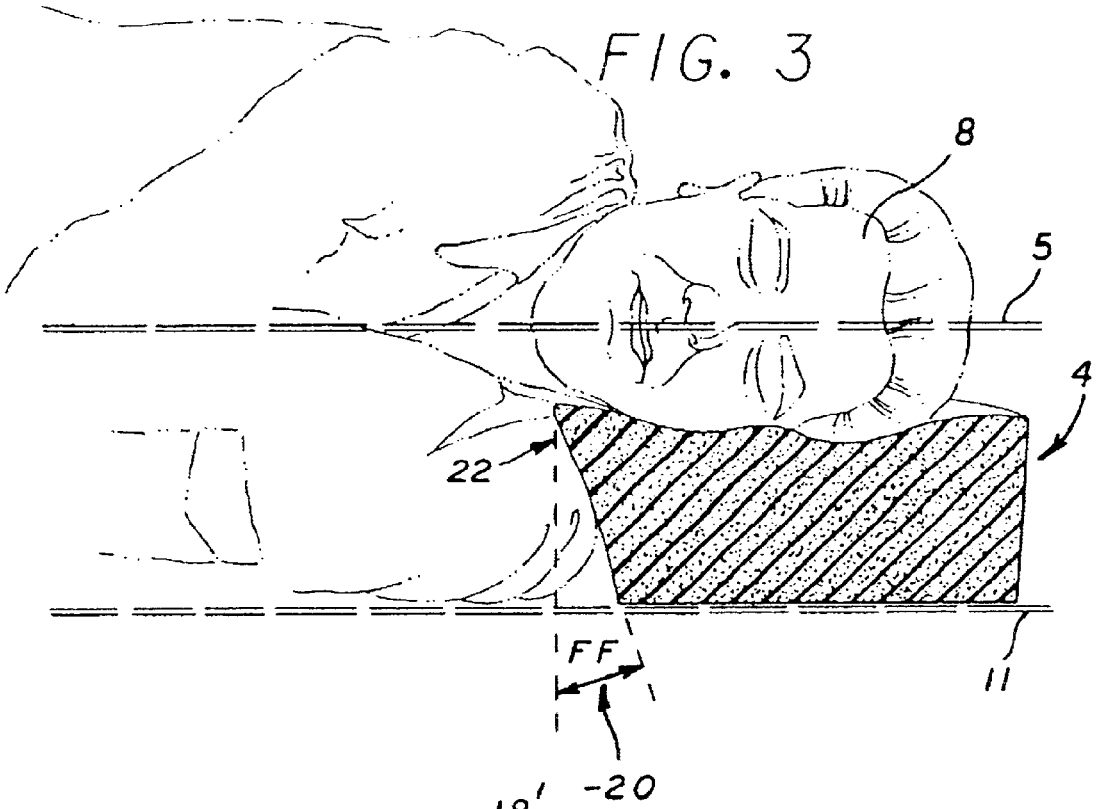
FIG. 3 is an end view of the pillow of FIG. 2 depicting its use by a laterally reclining user.

A therapeutic pillow is disclosed which provides support of the head, neck and shoulders of a user reclining in one of the two preferred sleeping positions: supine and lateral, such that a neutral cervical posture is maintained in both positions.

The support system for the head and neck is integral to the shape of the pillow and relieves pressure of body parts associated with the head and neck, such as the shoulders and arms, and thus decreases pressure points associated with muscle, ligaments, bursae, and bony prominences. This arrangement increase circulation to the skin and underlying connective tissue so as to deliver increased oxygen.

The pillow reduces pressure on the shoulders and arms of a human user reclining in the lateral position and provides a therapeutic cervical position in a laterally reclining user while providing a soft, comfortable supportive surface to conform to the user's temporal-mandibular joint, mandible, and other facial bones and features.

The pillow supports the head and neck of a reclining human user in a position that encourages and supports the healthy lordotic curvature of the user's cervical spine.

The cervical pillow also supports therapeutically the head and neck of a user in both supine and lateral positions as these positions change naturally during rest, without the user being required to rotate unnaturally in place in order to maintain his or her head in one location when changing positions.

The pillow may provide a very slight degree of therapeutic cervical traction and/or decompression to a reclining user's neck. This traction or decompressional force generally improves intra-articular circulation, decreases muscle tension, improves circulation and decompresses the intervertebral discs.

The therapeutic pillow provides optimal support of the head and neck in the supine and lateral sleeping positions by providing three-surfaces that conform to the three preferred positions of sleeping: on one's back, on one's left side, and on one's right side. The surfaces are provided by a triune arrangement of support surfaces which may be configured of three mutually connected pieces of supportive resilient material such a foam with varying contours which may form a substantially bilaterally symmetrical planar pillow.

The center section may have substantially bilaterally symmetrical and includes three portions: a thinner portion that may be substantially concave, and two adjacent thicker portions substantially identical to each other on either side of the thinner portion with a convex shape. The thinner portion is designed to accommodate the head of the reclining user. Each thicker portion is designed to support the user's neck. Together these three portions form a trough in which the head rests and by the convex edge of which the neck is supported, forming thereby a conforming, comfortable superior surface on which the supine user may recline his head and neck.

The end sections of the pillow provide support in the lateral sleeping posture. If a user using the pillow in a supine position, with his or her neck lying centrally on one of the thicker portions of the center section, and then rolls naturally to one side or the other until he or she is reclining in a lateral posture, the end section he or she has rolled toward should support the bottom side of the lateral user's face and head and maintain the user's cervical spine in the neutral position while allowing air passage. The end section where it attaches to the center section is narrower at the bottom than the top and thus has a cutout, hollow or angular area which provides a place for the shoulder and arm of the lateral user. This accommodation of the user's shoulder allows the user to maintain optimally the neutral cervical position in the lateral sleeping posture. Thus, the user may be supine and then naturally roll, rather than rotate in place, to the lateral sleeping position and maintain in both positions substantially optimal cervical posture and curvature to promote rest and therapy.

The top surfaces of the side sections are designed to provide a soft, comfortable supportive surface for a laterally reclining user that conforms to the user's temporal-mandibular joint, mandible and other facial bones and features. These surfaces, together with the convex portions of the center section, are designed to support the head of a user who is reclining laterally in a position corresponding to the location in which he would end up after he starts in a supine position with proper support from the center section, and then rolls naturally to the left or right side to a lateral position. The support provided to the user's facial features is designed to decrease ocular and nasal pressure and thus may contribute to improved circulation, air passage management, and decreased pressure on the sensitive ocular structures.

The end sections of the pillow may vary in height relative to the center section and may be higher than the center section to accommodate different sized user's. The end sections also provide some support for either side of the head of the supine user of the pillow.

The bilateral symmetry of the pillow permits it to be used in the same way when it is rotated 180 degrees of horizontal rotation. This mirroring feature permits the user to rotate the pillow and use its other side whenever the user so desires, or when the first side of the pillow shows indications of wear, damage or uncleanliness. In this way, the mirroring increases the durability and functional life of the pillow. The mirroring also tends to result in the shape of the pillow bearing a greater resemblance to the rectangular, bilaterally symmetrical shape of a standard bed pillow than most known therapeutic cervical pillows. This similarity may make the present pillow more aesthetically pleasing to a user who is accustomed to the appearance of standard pillows. The similarity may also permit the use with the present pillow of pillowcases and slipcovers designed for standard pillows.

Referring now to FIGS. 1–3 and 11, therapeutic pillow 10 includes a central support area 2 and side support areas 12 and 14. When a user such as user 8 is reclining in a supine position, the user's head is cradled in central support area 2 as shown in FIG. 1. When user 8 is reclining in a lateral or side posture as shown in FIG. 2 and FIG. 3, side supports 6 and 4 in side support areas 12 and 14 respectively, support user 8 and maintain the user's spine in a desirable configuration such as a substantially zero degree curve parallel to spinal reference S which is parallel to the bed surface 11.

Figure 20:
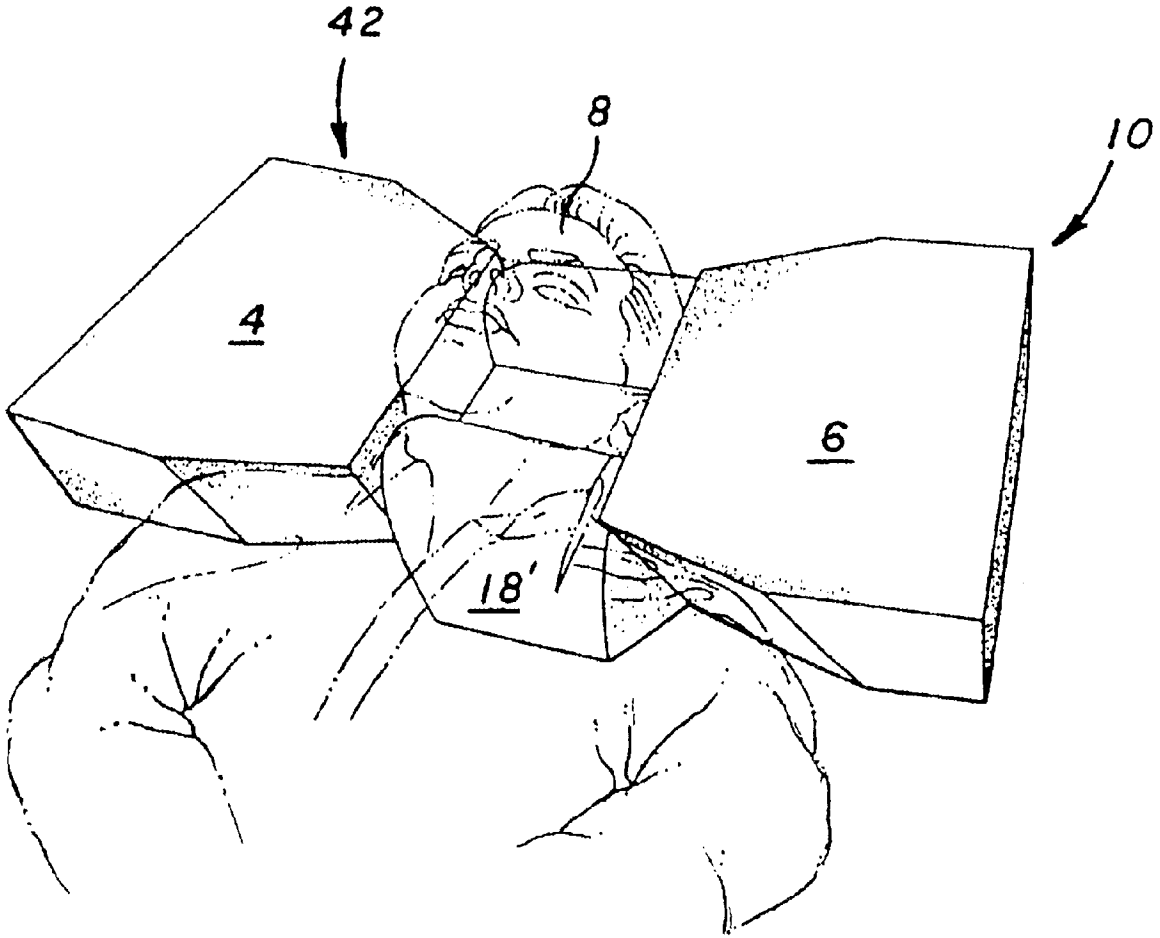
FIG. 20 is an oblique perspective of the therapeutic pillow of FIG. 1 depicting its use by a user in a second orientation.

In a first orientation 40 as shown in FIG. 1, the neck of user 8 is supported by first cervical support 18 with side support 4 on the user's left and side support 6 on the user's right. In a second orientation 42 as shown in FIG. 20, the neck of user 8 is supported by second cervical support 18' with side support 6 on the user's left and side support 4 on the user's right. The symmetrical arrangement of the elements of therapeutic pillow 10 permit identical use in both orientation 40 and orientation 42 thus doubling the effective life of therapeutic pillow 10.

Figure 4:
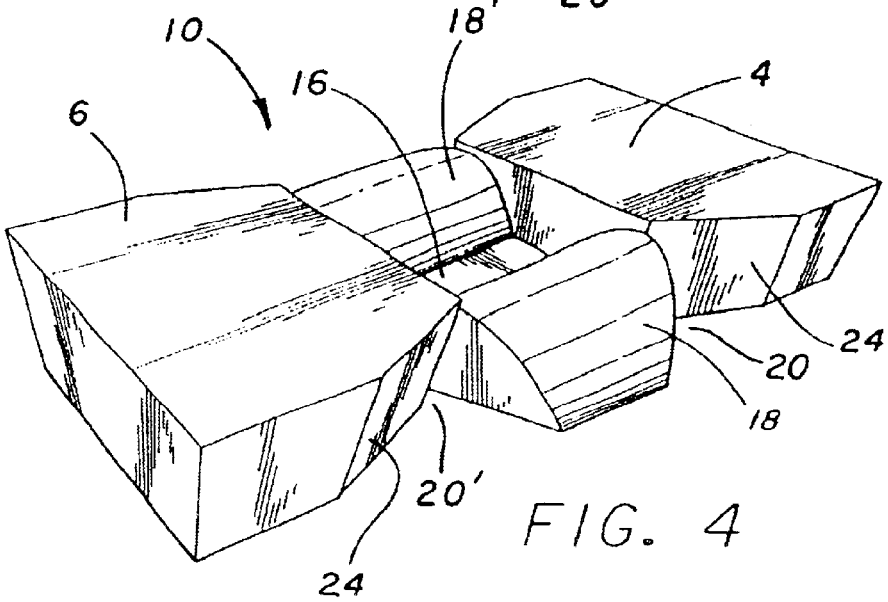
FIG. 4 is another perspective of a pillow in accordance with the present disclosure.
Figure 6:
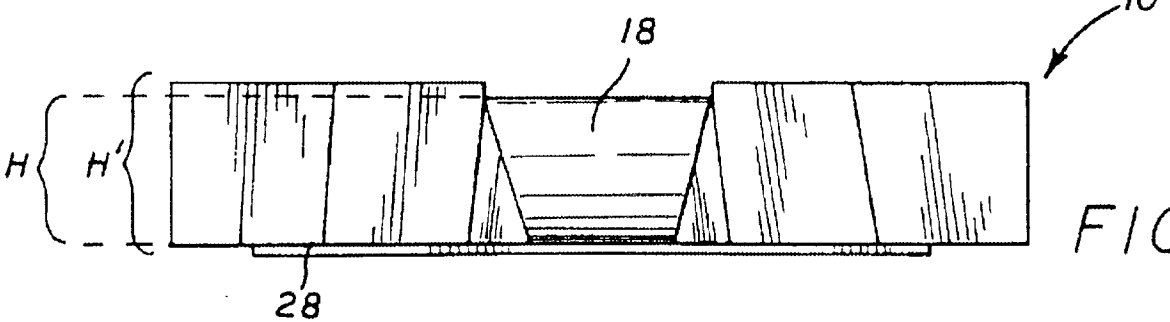
FIG. 6 is a side view of the pillow of FIG. 4.
Figure 8:
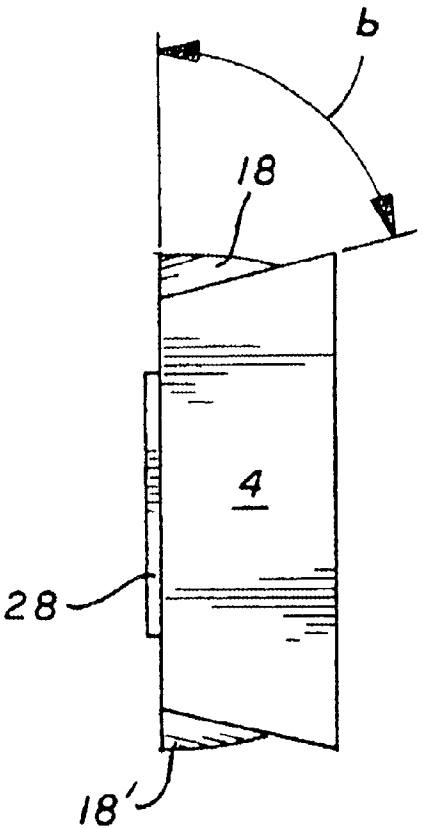
FIG. 8 is an end view of the pillow of FIG. 4.
Figure 19:
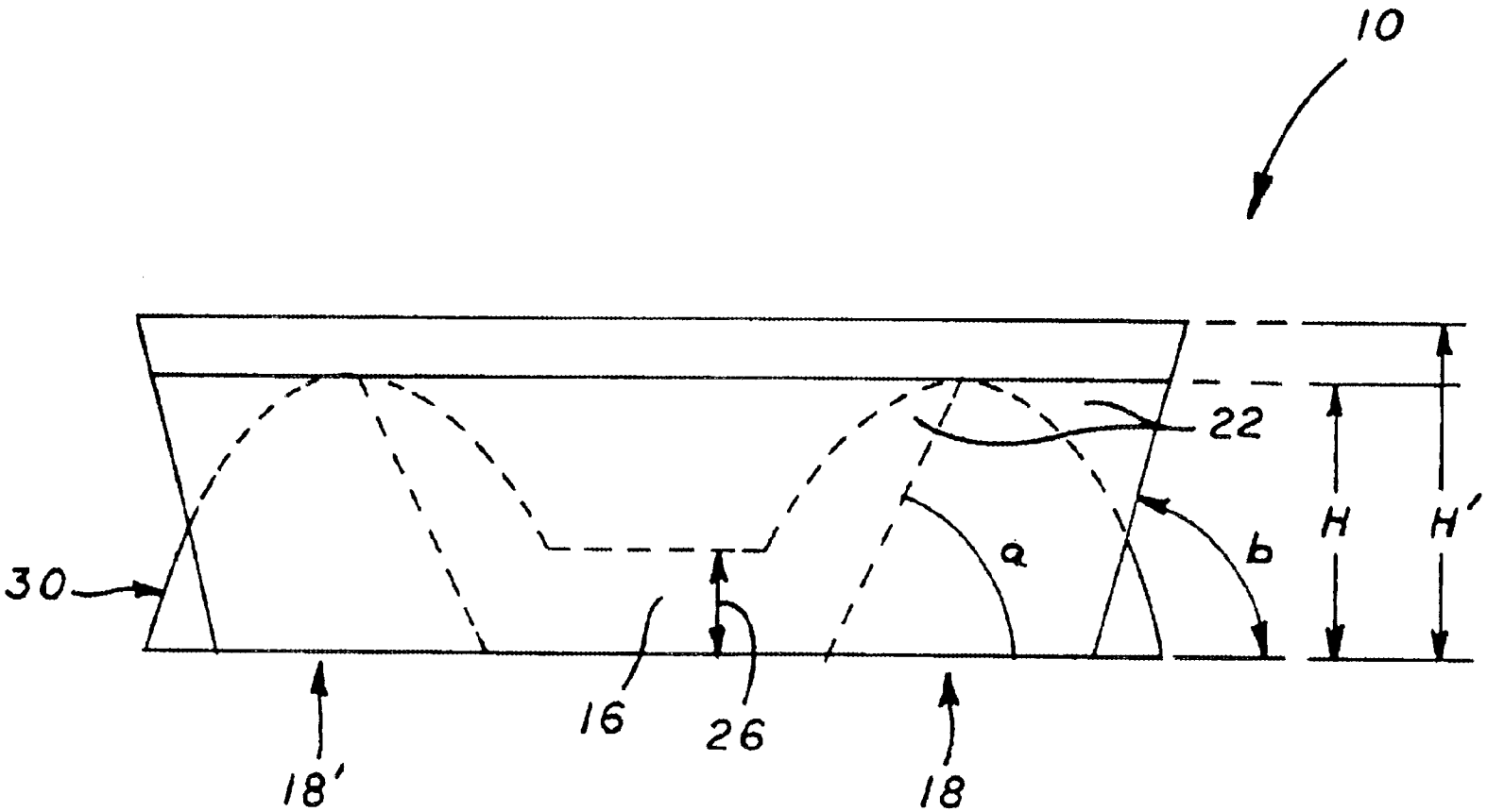
FIG. 19 is an end view of a pillow in accordance with the present disclosure.

Referring now to FIG. 4, in a currently preferred embodiment of the present disclosure, therapeutic pillow 10 includes first side support 6 and second side support 4 separated and joined by central pad 16 and first cervical support 18 and second cervical support 18'. First and second cervical supports 18 and 18' may have a semicircular curvature with radius H as shown in FIG. 19 and FIG. 6. Radius or height H may be any suitable dimension, such as from 3 to 5 inches. The shape of first and second cervical supports 18 and 18' may be selected to provide therapeutic cervical traction and/or decompression to a reclining user's neck. The therapeutically appropriate amount of traction will depend on the user's head weight, cervical curvature head positioning, past and existing cervical conditions and injuries, and other factors.

Figure 5:
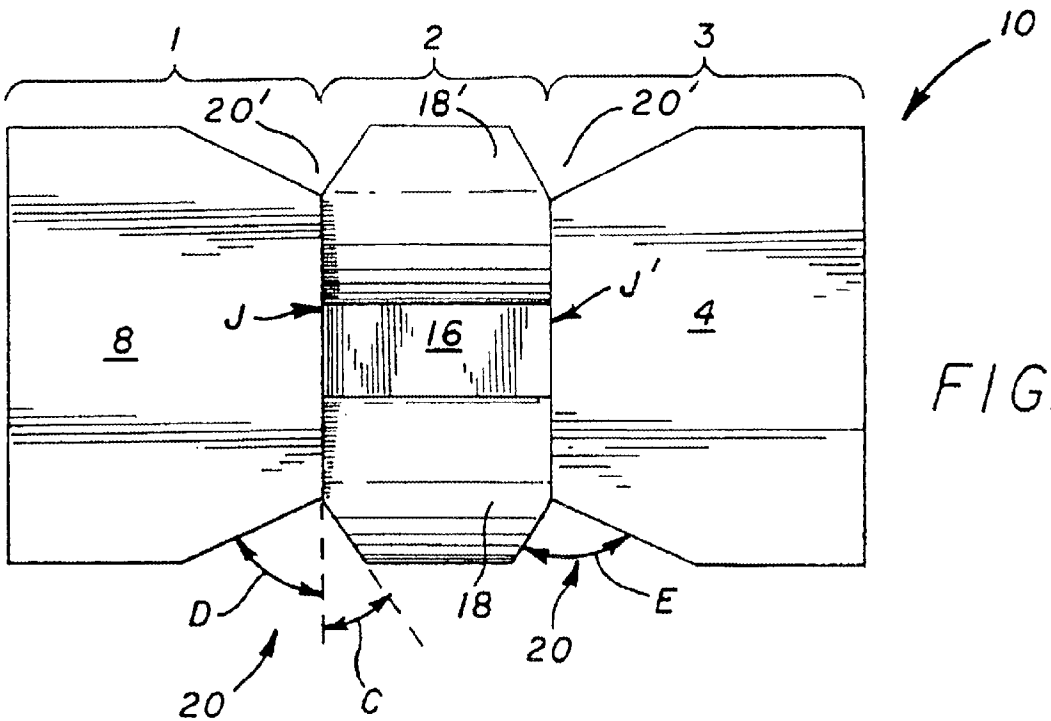
FIG. 5 is a top view of the pillow of FIG. 4.

Referring now to FIG. 5 and FIG. 6, first side support 6 may be secured to central pad 16 and first cervical support 18 and second cervical support 18' along first joint J, and second side support 4 may be secured to central pad 16 and first cervical support 18 and second cervical support 18' along second joint J'. Stability pad 28, if present, may also be used to secure and stabilize first side support 6, second side support 4, central pad 16 and/or first cervical support 18 and second cervical support 18' in the relative positions shown in FIG. 5, FIG. 6, FIG. 7, FIG. 8 and FIG. 9.

Referring to FIG. 19, central pad 16 may have a pad depth 26 as shown. Pad depth 26 may vary depending on the material density and elasticity and is typically on the order of one inch. In an alternate embodiment, central pad 16, first cervical support 18 and second cervical support 18' may be formed as a contiguous element, central element 30.

Figure 7:
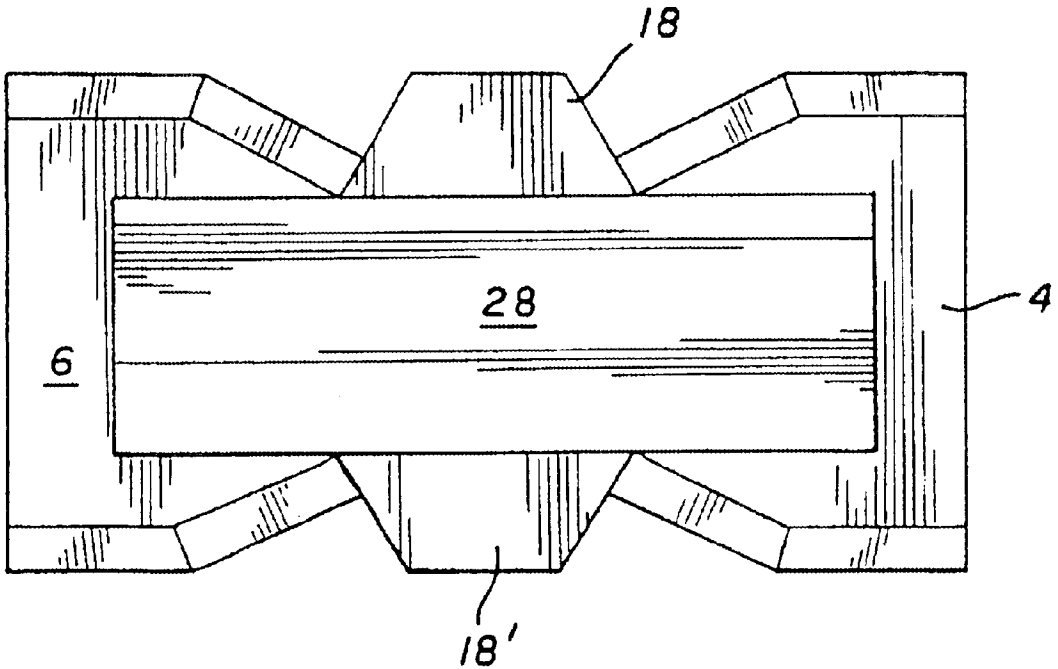
FIG. 7 is a bottom view of the pillow of FIG. 4.
Figure 9:
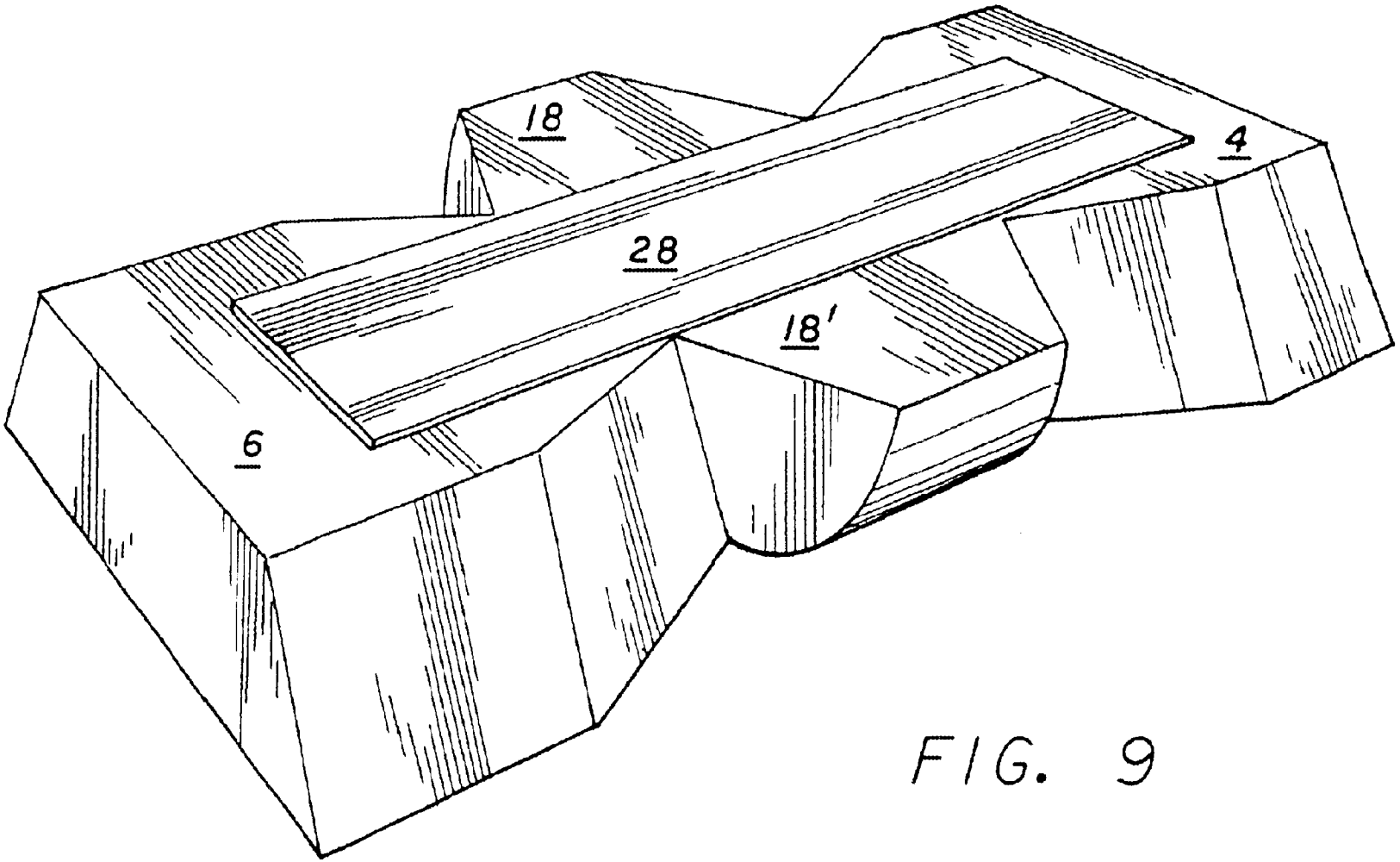
FIG. 9 is an oblique bottom view of the pillow of FIG. 4.
Figure 12:
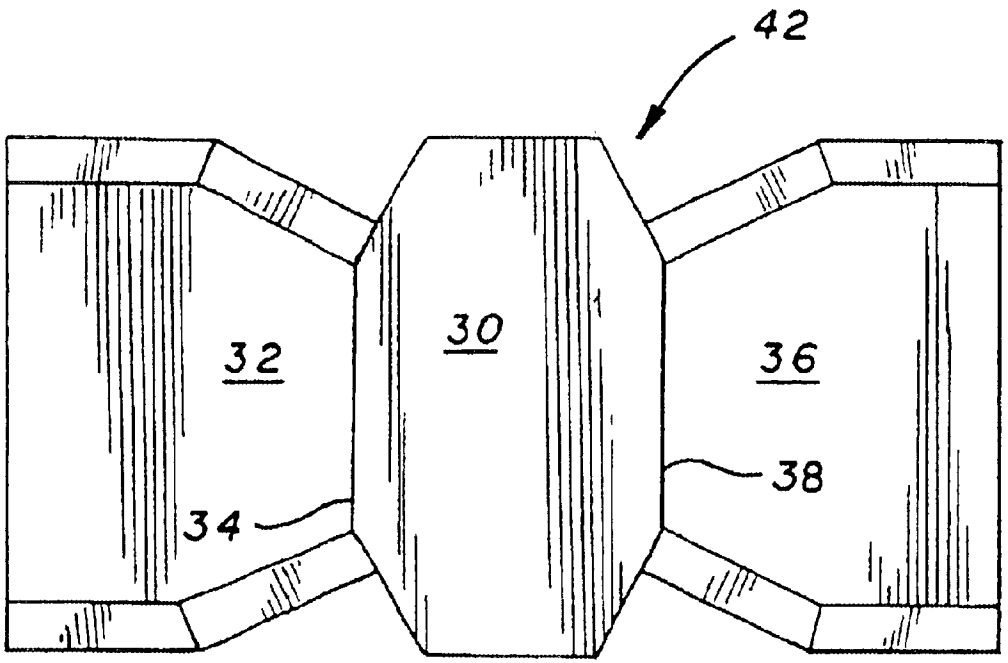
FIG. 12 is a bottom view of another embodiment of a pillow in accordance with the present disclosure.

Referring now to FIG. 12, therapeutic pillow 42 may be formed of central element 30 joined to first side element 32 along joint 34 and joined to second side element 36 along joint 38. In this embodiment, a stability pad such as stability pad 28 shown in FIG. 7 is not used.

Figure 18:
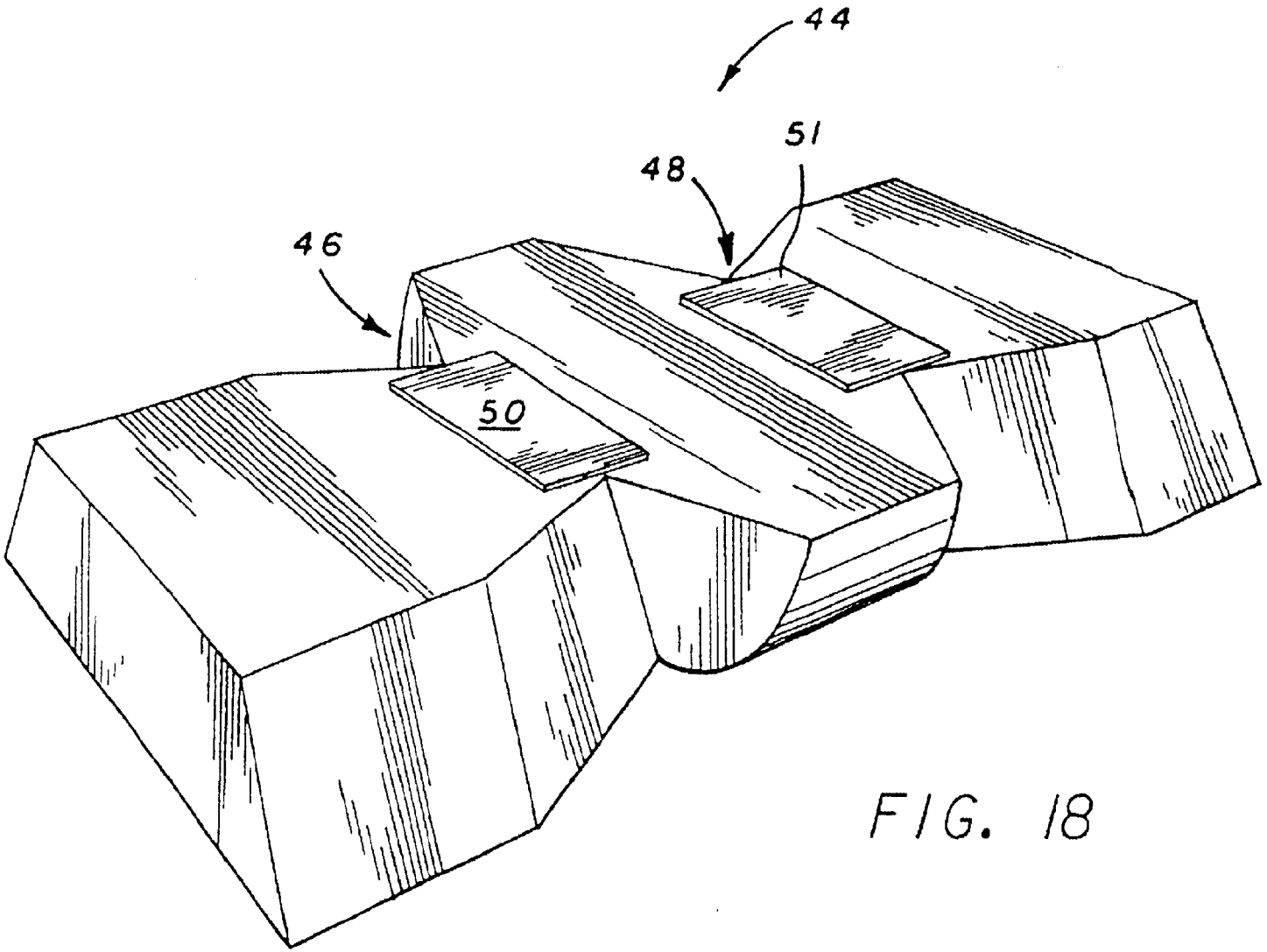
FIG. 18 is an oblique perspective of an alternate embodiment of a pillow in accordance with the present disclosure.

Referring now to FIG. 18, therapeutic pillow 44 may be any suitable embodiment of the present disclosure. Joint 46 and joint 48 may be reinforced by the use of pads 50 and 51 to support each joint. Pads 50 and 51 may be any suitable material and attached using any suitable technique.

Referring now again to FIG. 3, therapeutic pillow 10 may also include shoulder reliefs 20 and 20'. Shoulder reliefs 20 and 20' may be biaxial in that a space is provided for the user's shoulder between side supports 4 and 6 and central support 16 both in the horizontal and vertical planes. The horizontal relief is illustrated by horizontal angular space E in FIG. 5 while the vertical relief is illustrated by vertical angular space F shown in FIG. 3.

The vertical portions of shoulder reliefs 20 and 20' may be formed by undercutting vertical side support surfaces 24 of side supports 4 and 6 at angle a, shown in FIG. 19, and/or by also creating overhang 22 to provide variable support to user 8 in a lateral position as shown in FIG. 3 without creating pressure on the shoulder of user 8. Overhang 22 may be formed by undercutting side support surfaces 24 to form a slight, concave recess.

Referring again to FIG. 5, the horizontal portions of shoulder reliefs 20 and 20', indicated as horizontal angular space E, may be formed in part by cutting off the corners of cervical support 18, and/or central pad 16, to form angular relief space C. Similarly, horizontal angular space E may also be formed in part by cutting of the corners of side supports 4 and 6 to create angular relief space D. Angles a, C and D subtend the vertical and horizontal portions of shoulder relief 20 and its mirror image, shoulder relief 20'. Angle a may be any angle between 30 and 50 degrees with 40 degrees being the currently preferred angle.

Figure 10:
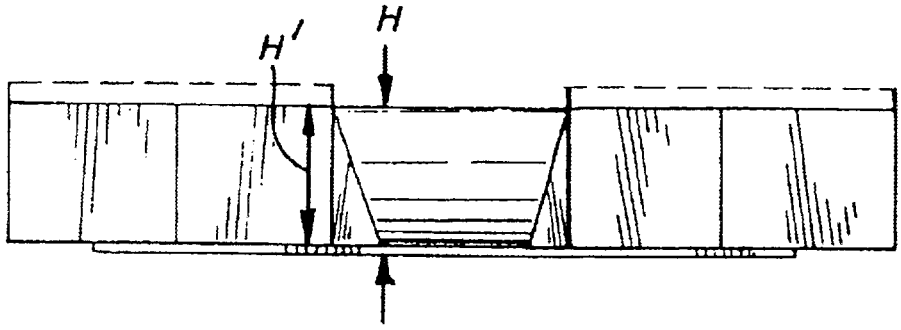
FIG. 10 is a side view of another pillow embodiment according to the present disclosure.
Figure 11:
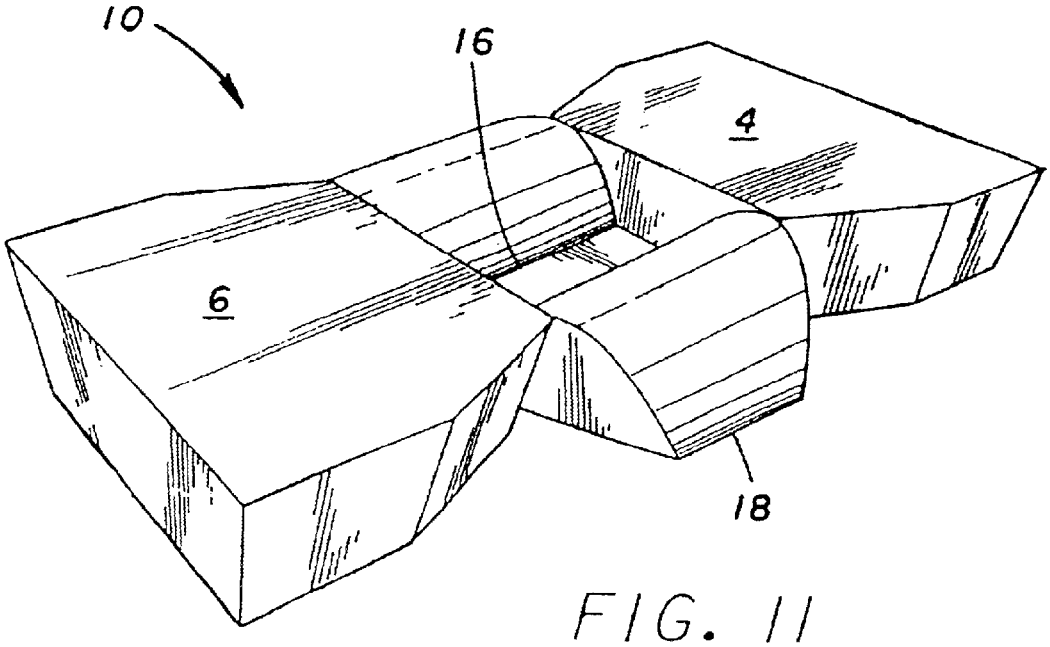
FIG. 11 is an oblique view of the pillow of FIG. 10
Figure 13:
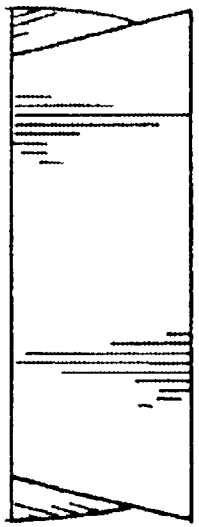
FIG. 13 is an end view of the pillow of FIG. 12.

Therapeutic pillow 10 may be made in various sizes to accommodate various sizes of user's. As discussed above with regard to FIGS. 6 and 19, cervical supports 18 and 18' may have a semicircular curvature with radius or height dimension H preferably in the range of 3 to 5 inches. Similarly, dimension H' which represents the height of side supports 4 and 6 may vary in the range of about 3 to 5½ inches and is generally 4 to 5 inches for an average adult. Dimension H' may be adjusted for example, to 4 inches or smaller for people of smaller stature or use by children of various ages in order to take therapeutic account of differences in the measurements of their shoulders, heads, necks, the softness of their bed surfaces, the depth of their shoulder/weight impression into their bed surfaces, and anatomically optimal spinal curvatures. In another embodiment of the present disclosure dimension H' may be identical to dimension H as shown in FIG. 10.

Figure 16:
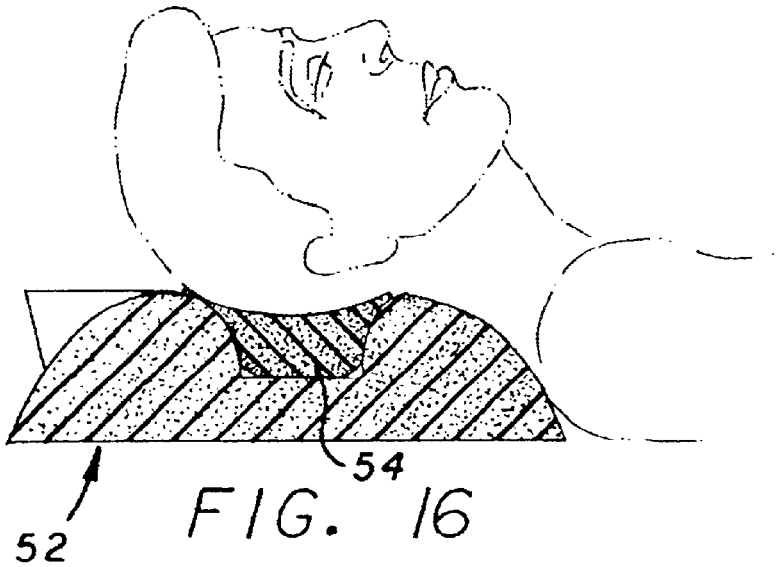
FIG. 16 is a cutaway view of the pillow of FIG. 14 cut along A—A".

Referring now to FIG. 14–FIG. 16, therapeutic pillow 52 may be combined with insert 54 to accommodate specific therapeutic regimes as shown in FIG. 16. Face 56 of insert 54 may be shaped to generally accommodate face 58 of first and second cervical supports 60 and 60'.

Figure 17:
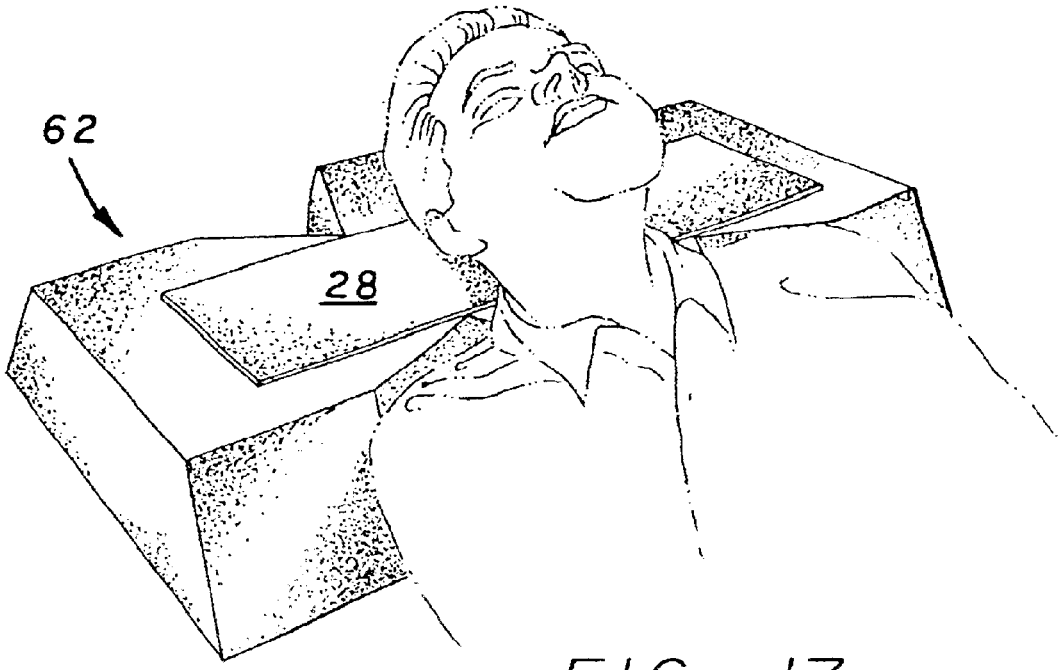
FIG. 17 is an oblique perspective of an alternate orientation of a pillow in accordance with the present disclosure.

Referring now to FIG. 17, in a further embodiment of the present disclosure therapeutic pillow 62 may be used in a orientation in which stability pad 28 and the surfaces to which it is attached are in direct contact with a user.

Therapeutic pillow 10 may be made of Tempur™ material. Tempur™ is a trademark of Fagerdala World Foams AB Corporation of Sweden.

Pillow 10 may be constructed of separate pieces forming sides 4 and 6 and the various portions of central pad 16 and/or may be formed from a single piece of material.

Having now described the invention in accordance with the requirements of the patent statutes, those skilled in this art will understand how to make changes and modifications in the present invention to meet their specific requirements or conditions. Such changes and modifications may be made without departing from the scope and spirit of the invention as set forth in the following claims.

What is claimed is:

1. A therapeutic pillow comprising:

a central pad including a generally rectangular head support pad and a pair of cervical support pads each positioned along one of a first set of opposite edges of the head support pad; and a pair of side support pads each positioned along one of a second set of opposite edges of the head support pad, a portion of each side support pad adjacent one of said first pair of opposite edges of the head support pad being relieved to form a angular shoulder relief area for a user reclining in a lateral position with the user's face supported by one of said side support pads and the user's cervical spine supported by one of the cervical support pads.

2. The therapeutic pillow of claim 1, wherein at least a portion of each side support pad adjacent the other one of said first pair of opposite edges of the head support pad is relieved to form an angular shoulder relief area.

3. The therapeutic pillow of claim 1, wherein a portion of the central pad adjacent each of said angular shoulder relief areas formed in the side support pads is also relieved to increase the shoulder relief area.

4. The therapeutic pillow of claim 3 wherein at least a portion of each side support pad adjacent the other one of said first pair of opposite edges of the head support pad, and a portion of the central pad adjacent each of said the shoulder relief areas formed in the side support pads, are also relieved to increase the shoulder relief area.

5. The therapeutic pillow of claim 1 wherein the angular shoulder reliefs subtend a horizontal angle of between about 60 and 100 degrees.

6. The therapeutic pillow of claim 5 wherein the angular shoulder reliefs subtend a horizontal angle of about 90 degrees.

7. The therapeutic pillow of claim 4 wherein the relieved portion of each side support pad subtends an angle of between about 30 and 50 degrees.

8. The therapeutic pillow of claim 4 wherein each relieved portions of the central pad subtend an angle of between about 40 degrees.

9. The therapeutic pillow of claim 1 wherein the relieved portion of each side support pad is also relieved in a vertical plane by undercutting so that the upper surface of each side support pad extends beyond the lower surface to provide additional support for the user's face and additional relief area for the user's shoulder.

10. The therapeutic pillow of claim 9 wherein the relief in the vertical plane subtends a vertical angle of about 30 to 50 degrees.

11. The therapeutic pillow of claim 10 wherein the relief in the vertical plane subtends a vertical angle of about 40 degrees.

12. The therapeutic pillow of claim 9 wherein the relief in the vertical plane includes a generally concave surface forming an overhang in the upper surface of each side support pad for providing additional support for the user's face.

13. The therapeutic pillow of claim 1 wherein the vertical height of each side support pad is in the range of about 3 to 5½ inches.

14. The therapeutic pillow of claim 1 wherein the vertical height of each side support pad is on the order of about 4 to 5 inches.

15. The therapeutic pillow of claim 1 wherein the vertical height of each cervical support pad is on the order of about 3 to 5 inches.

16. The therapeutic pillow of claim 1 wherein the vertical height of each side support pad greater than the vertical height of each cervical support pad.

17. The therapeutic pillow of claim 1 wherein the vertical height of each side support pad about the same as the vertical height of each cervical support pad.

18. The therapeutic pillow of claim 1 wherein the vertical heights of the side support and cervical support pads permit a user to roll easily between supine and lateral reclining positions.

19. The therapeutic pillow of claim 1 wherein the central pad and side support pads form a pillow having substantially bilaterally symmetry so that the pillow may be used after 180 degrees of horizontal rotation.

20. The therapeutic pillow of claim 1, wherein portions of the central and/or side support pads are constructed of TEMPUR™ foam.

21. The therapeutic pillow of claim 1, further comprising:

a resilient insert sized to fit between the cervical support pads to increase the height at which the user's head is supported.

* * * * *

UNITED STATES PATENT AND TRADEMARK OFFICE

CERTIFICATE OF CORRECTION

PATENT NO. : 6,817,049 B1
DATED : November 16, 2004
INVENTOR(S) : Hall, Raymond F.

It is certified that error appears in the above-identified patent and that said Letters Patent is hereby corrected as shown below:

Column 2,
Line 4, replace "Bide" with -- side --.
Line 60, replace "A—A"" with -- A-A' --.

Column 3,
Line 43, replace "three-surfaces" with -- three surfaces --.

Signed and Sealed this

Twenty-eighth Day of June, 2005

JON W. DUDAS
*Director of the United States Patent and Trademark Office*